US009744583B2

(12) United States Patent
Yoo

(10) Patent No.: US 9,744,583 B2
(45) Date of Patent: Aug. 29, 2017

(54) APPARATUS FOR MANUFACTURING METALLIC CAN

(71) Applicant: Il Han Yoo, Seoul (KR)

(72) Inventor: Il Han Yoo, Seoul (KR)

( * ) Notice: Subject to any disclaimer, the term of this patent is extended or adjusted under 35 U.S.C. 154(b) by 201 days.

(21) Appl. No.: 14/663,296

(22) Filed: Mar. 19, 2015

(65) Prior Publication Data

US 2015/0360280 A1 Dec. 17, 2015

(30) Foreign Application Priority Data

Jun. 17, 2014 (KR) ..... 10-2014-0073330

(51) Int. Cl.
*B21D 51/26* (2006.01)

(52) U.S. Cl.
CPC ..... *B21D 51/26* (2013.01); *B21D 51/2615* (2013.01); *B21D 51/2623* (2013.01); *B21D 51/2692* (2013.01); *Y10T 29/5122* (2015.01)

(58) Field of Classification Search
CPC ..... B21D 43/02; B21D 43/04; B21D 43/12; B21D 19/04; B21D 19/12; B21D 51/26; B21D 51/2623; B21D 51/2638; B21D 51/2692; B21D 51/2615
See application file for complete search history.

(56) References Cited

U.S. PATENT DOCUMENTS

| | | | | |
|---|---|---|---|---|
| 5,556,364 | A | 9/1996 | Konzal | |
| 7,464,573 | B2 * | 12/2008 | Shortridge | B21D 51/2615 72/405.03 |
| 7,503,741 | B2 * | 3/2009 | Gillest | B21D 19/12 413/1 |
| 8,037,728 | B2 | 10/2011 | Hosoi | |
| 9,061,343 | B2 * | 6/2015 | Watkins | B21D 51/2638 |
| 2012/0198905 | A1 | 8/2012 | Yoo | |

FOREIGN PATENT DOCUMENTS

| | | | |
|---|---|---|---|
| CN | 202963291 | U | 6/2013 |
| JP | 2013508166 | A | 3/2013 |
| KR | 1020060092202 | | 8/2006 |
| KR | 1020110042804 | | 4/2011 |
| KR | 20130117590 | A | 10/2013 |
| KR | 1020130117590 | | 10/2013 |

* cited by examiner

*Primary Examiner* — Edward Tolan
(74) *Attorney, Agent, or Firm* — David R. Stevens; Stevens Law Group

(57) ABSTRACT

Provided are a method a for manufacturing metallic cans and resulting structure apparatus, where the method provides a continuous manufacturing process carried out instead of individually carrying out separate processing, thereby preventing the provision of any additional equipment and improving the efficiency in the manufacturing of metallic cans. A method for manufacturing metallic cans can be realized by simultaneously carrying out the sealing lip processing and the curling part processing by a press method, thereby simplifying the manufacturing facilities, manufacturing procedure or the like.

9 Claims, 13 Drawing Sheets

APPARATUS FOR MANUFACTURING METALLIC CAN

CROSS-REFERENCE TO RELATED APPLICATION

This application claims the benefit of Korean Patent Application 10-2014-0073330, filed Jun. 17, 2014.

TECHNICAL FIELD

The present invention relates to an apparatus for manufacturing metallic cans, wherein the sealing lips and the curling parts of metallic cans can be processed using a press method.

BACKGROUND ART

In general, metallic cans typically used as the storage containers of beverage are mainly made from aluminum or iron materials.

FIG. 1 is a view showing a metallic can manufactured by a prior art method. As shown FIG. 1, the prior art metallic can is provided with a basic body 2 in the shape of a bottle having a bottle neck so that the prior art metallic can is called as a necking can.

The metallic can includes a sealing lip 3 provided to the outside surface of an upper end portion of the bottle neck part so as to carry out sealing of the metallic can through the coupling with a cap, a beading part 4 provided at the lower portion of the sealing lip 3 so as to check the opening of the cap, which is coupled for the sealing, and to carry out a pilfer-proof function, and a curling part 5 provided to the end portion of the bottle neck part so as to carry out finishing.

Additionally speaking, the metallic can as shown in FIG. 1 is formed with the body part 2 in the shape of a bottle having a bottle neck by carrying out drawing processing (cylindrical shape having a bottom surface) and necking processing with respect to a plate shaped material.

Then, the sealing lip 3 is formed by processing a coupling part in the shape of a screw on the outside surface of the upper end portion of the bottle neck part, and the beading part 4 is formed by carrying out beading processing at the lower portion of the sealing lip 3. Sequentially, the curling part 5 is formed by carrying out the necking processing twice at the end portion of the bottle neck part and carrying out flange forming and curling processing for folding and curling the end portion in the outward direction.

At this time, the procedure for forming the sealing lip 3 by processing the coupling part in the shape of a screw on the outside surface of the upper end portion of a metallic can 1 so as to be coupled with a cap is carried out by inserting an inside die in a screw shape to the inside of the inlet of the bottle neck part of the can 1, arranging an outside die to be in contact with the outside of the bottle neck part of the can 1, and forming the sealing lip 3 by simultaneously rotating the inside die and the outside die along the periphery of the can 1, wherein a step for forming the beading part 4 is additionally carried out at the lower portion of the sealing lip 3.

However, the prior art technique for processing the metallic can 1 as described above has a disadvantage that the manufacturing process of the metallic can 1 becomes complicated, deteriorating productivity because the process for forming the sealing lip 3 is separately carried out and the process for forming the curling part 5 also has to be additionally carried out after the sealing lip forming process.

In addition, the prior art technique for processing the metallic can 1 has another disadvantage that an additional equipment as well as an additional power supply means have to be provided for rotating the metallic can 1 because the metallic can 1 also rotates when the sealing lip 3 is formed through the rotation motion of the inside die and the outside die such that the sealing lip 3 is formed in the shape of a screw.

SUMMARY OF THE INVENTION

Problems to be Solved by the Invention

The present invention has been made so as to resolve the above-described problems, and its objective is to provide a method for manufacturing metallic cans in a continuous procedure instead of individually carrying out separate processing while preventing the provision of any additional equipment such processing, thereby improving the efficiency of the manufacturing of metallic cans.

Further, the present invention has another objective to provide a method for manufacturing metallic cans in which sealing lip processing is carried out simultaneously with the curling part processing by a press method, thereby simplifying manufacturing facilities, manufacturing procedure or the like.

Means for Solving the Problems

In order to achieve the above and any other objectives of the present invention, according to the present invention, in an apparatus for manufacturing metallic cans, which includes a lower plate forming a bottom plate; a press provided for carrying out linear movement in the vertical direction with respect to the lower plate; a forming part having a guide provided to the lower plate, a plurality of holders provided for fixing metallic cans and being conveyed along the guide and a plurality of molds provided to the press; a convey means for conveying the holders along the guide; and a driving means for driving the press, the improvement, comprising: a lip processing structure for forming a sealing lip to the outside surface of the upper end of the bottle neck of a metallic can, which is conveyed in a fixed state with respect to the holder along the guide in the linear direction by the convey means, such that the sealing lip can seal the bottle neck through the coupling with a cap; and a curling part processing structure for forming a curling part at the upper end of the bottle neck, wherein the lip processing structure and the curling part processing structure are consecutively provided.

Effect of the Present Invention

According to the apparatus for manufacturing metallic cans structured as above in the present invention, continuous manufacturing process is carried out instead of individually carrying out separate processing, thereby preventing the provision of any additional equipment and improving the efficiency in the manufacturing of metallic cans.

Further, according to the invention, a method for manufacturing metallic cans can be realized by simultaneously carrying out the sealing lip processing and the curling part processing by a press method, thereby simplifying the manufacturing facilities, manufacturing procedure or the like.

MODES FOR CARRYING OUT THE INVENTION

Hereinafter, embodiments of the present invention will now be described with respect to the configuration in detail with reference to FIG. 2 to FIG. 13.

Figure 1:
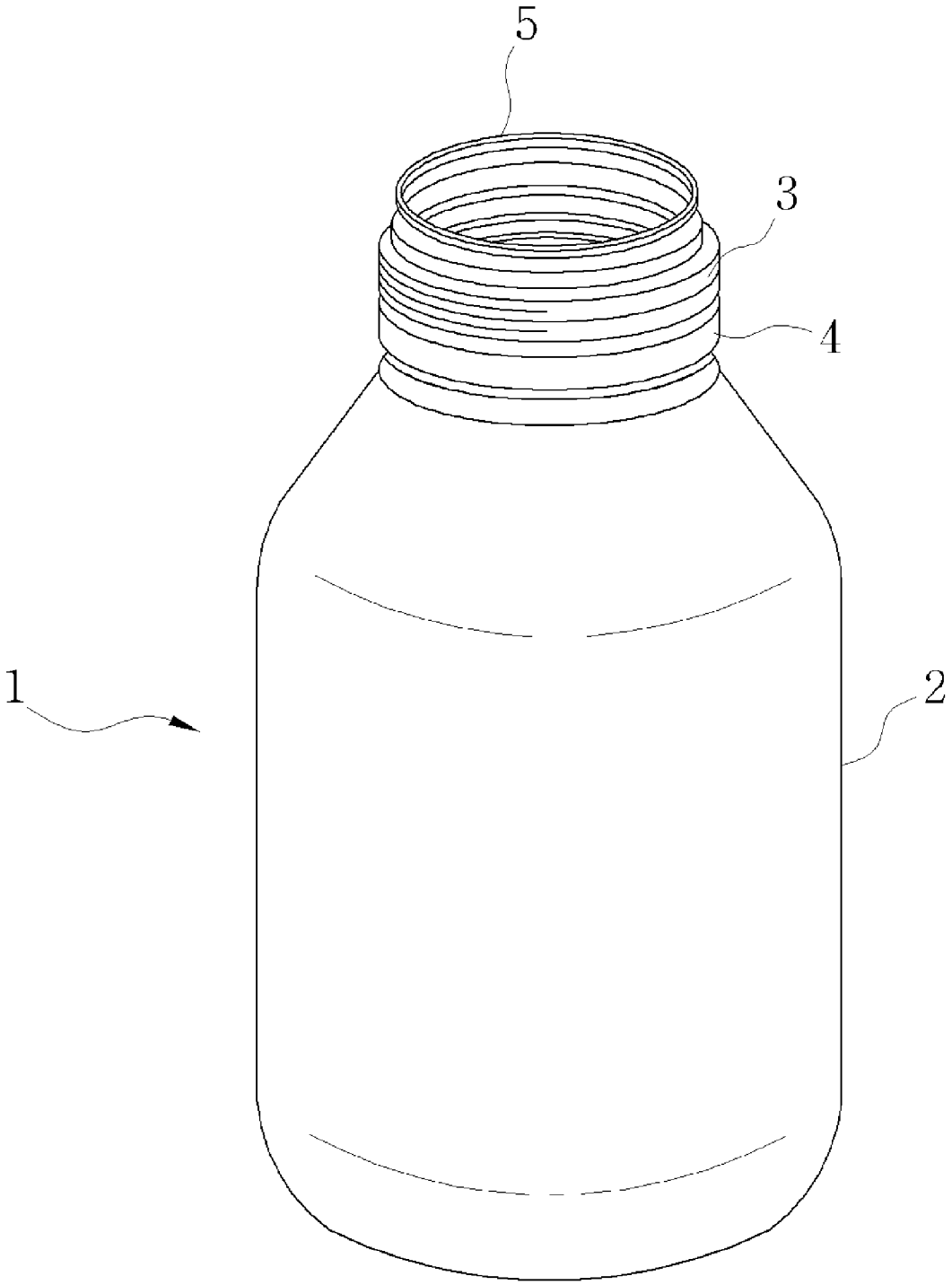
FIG. 1 is a perspective view showing a metallic can manufactured according to the prior art.
Figure 2:
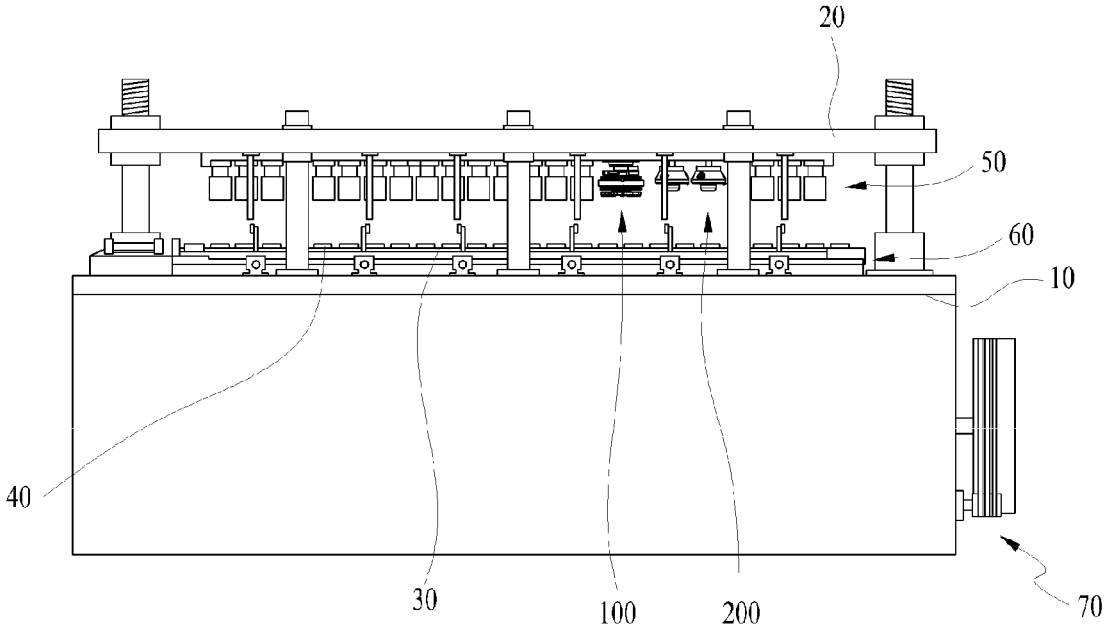
FIG. 2 is a view showing an apparatus for manufacturing metallic cans according to the present invention.

FIG. 2 is a perspective view showing an apparatus for manufacturing metallic cans according to the present invention. Referring to FIG. 2, cans C for which drawing has been finished are continuously moved in a straight direction such that sealing lip processing and curling processing can be carried out.

Herein, with respect to the configuration for linearly moving metallic cans C, Korean patent publication No. 1058778 discloses an apparatus for manufacturing a necking can, comprising: a lower plate 10 for forming a bottom surface; a press 20 provided for carrying out linear movement in the vertical direction with respect to the lower plate 10; a guide 30 provided to the lower plate 10; a forming part 50 having a plurality of holders 40 provided for fixing metallic cans C and being conveyed through the guide 30 and a plurality of molds provided to the press 20; a convey means 60 for conveying the holders 40 along the guide 30; and a driving means 70 for driving the press 20. The metallic cans C are continuously conveyed in a linear direction by the convey means 60 in a state, in which the metallic cans C are fixed by the holders 40, and continuously provided with sealing lips and curling parts by a lip processing structure 100 for forming sealing lips on the outside surface of the upper end of the bottle neck of the cans C so as to carry out sealing together with caps and a curling part processing structure 200 for forming curling parts at the upper ends thereof.

Figure 3:
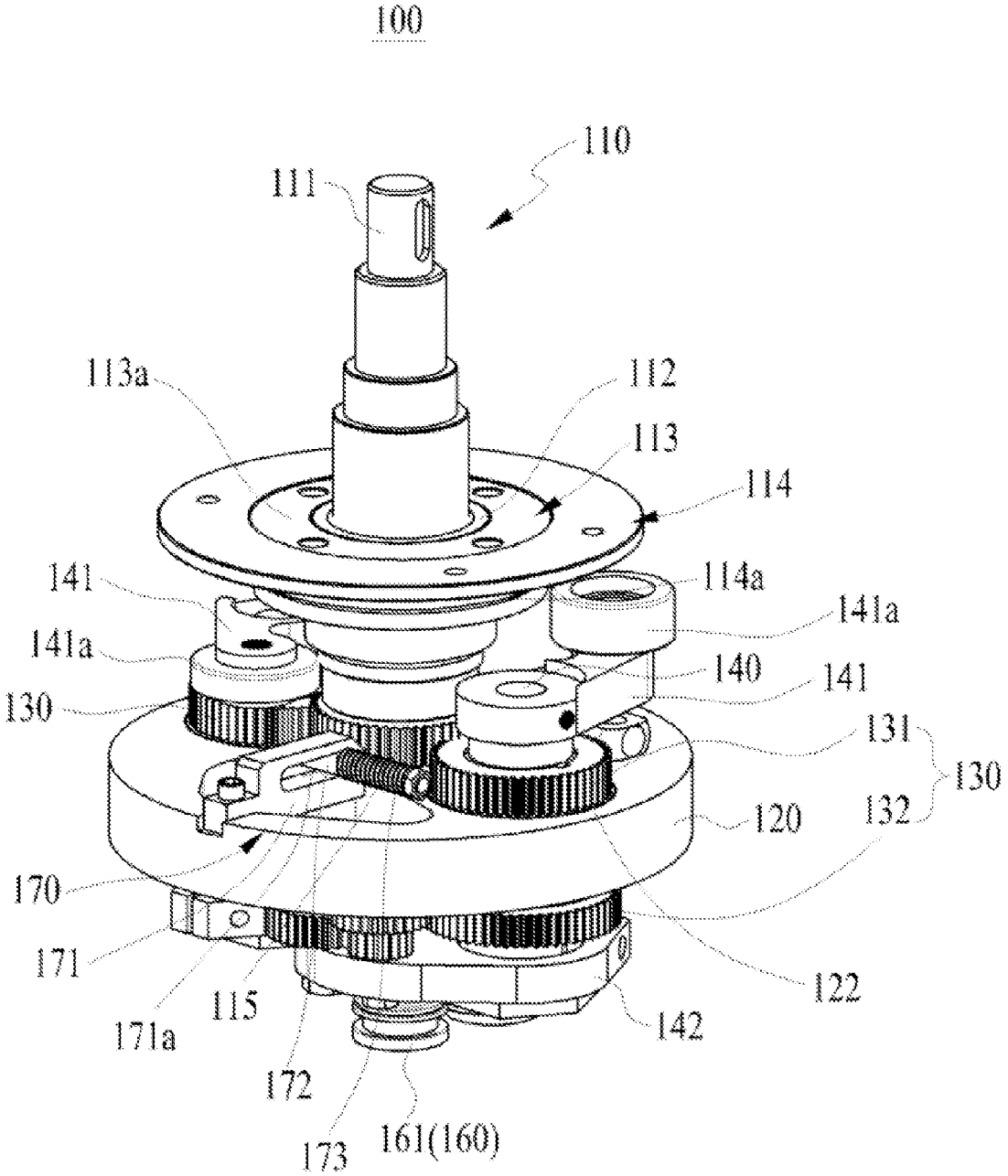
FIG. 3 is a perspective view showing a sealing lip processing device in the apparatus for manufacturing metallic cans according to the present invention.
Figure 4:
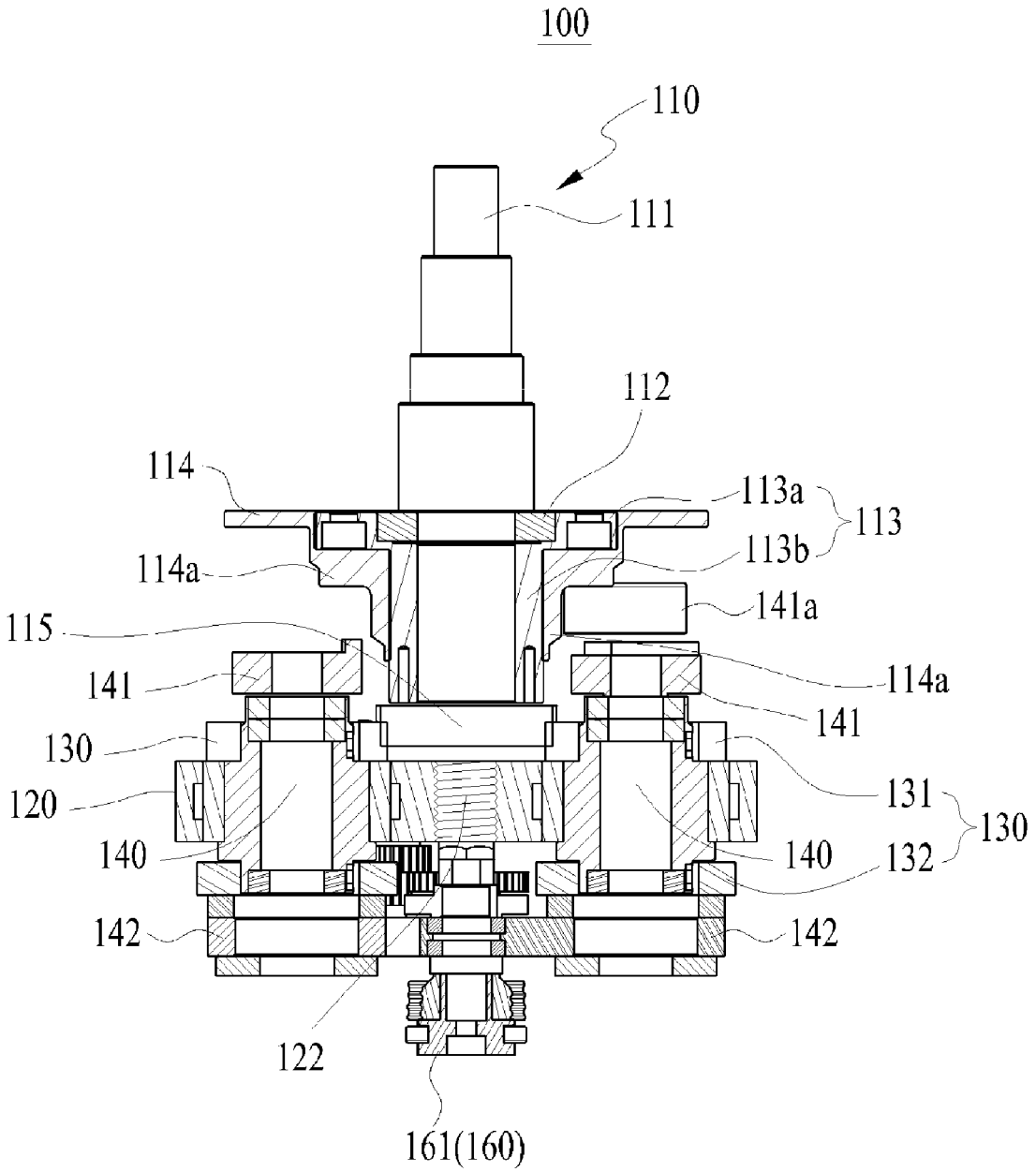
FIG. 4 is a sectional view showing a lip processing structure according to the present invention.

As shown in FIG. 3 and FIG. 4, the lip processing structure 100 is provided with a shaft driving part 110 for the movement and rotation of molds.

The shaft driving part 110 includes a central shaft 111 which is connected to the press 20 so as to vertically operate together with the press 20 and simultaneously rotate by a driving motor (not shown) when the press 20 operates.

In addition, the shaft driving part 110 includes a bearing 112 provided to the outside periphery of the central shaft 111 and supporting the central shaft 111, and a central shaft support 113 provided to the outside periphery of the bearing 112 so as to maintain separate operation relations and having a flange part 113*a* and a hollow part 113*b* connected to the press 20 so as to vertically operate.

As mentioned above, the central shaft support 113 is connected to the press 20 through a coupling member (not shown), such as an annular rod or the like which is inserted into a coupling hole (not shown) formed in the flange part 113*a*.

A cam part 114 is provided to the outside periphery of the central shaft support 113 and has a stepped cam 114*a* which has a diameter decreasing towards the center portion thereof and is formed in a stepped shape in the downward direction.

Herein, even though the cam part 114 can be provided with the stepped cam 114*a* in the present invention, the cam part 114 is not limited thereto and can also be formed in a tapered shape in a diameter decreasing downwards.

At this time, the bearing 112, the central shaft support 113 and the cam part 114 are formed to commonly share the single central shaft 111.

A central gear 115 is provided to the immediately lower portion of the cam part 114 and fixed to the central shaft support 113 so as to operate in association with the central shaft support 113, wherein the central gear 115 operates together with the central shaft support 113 in the vertical direction.

Further, a rotation plate 120 formed in the shape of a circular disc is provided to the lower portion of the cam part 114 to be spaced therefrom at an interval and coupled to the central shaft 111, wherein the central gear 115 is axially fixed and supported to the hollow part 113*b* of the central shaft support 113 and simultaneously the rotation plate 120, coupled to the central shaft 111, is connected to at the lower portion of the central gear 115.

As shown in FIG. 4, the rotation driving force of the central shaft 111 is intactly transmitted to the rotation plate 120 in a state, in which the lower end of the central shaft 111 is coupled in a coupling hole 122 provided to a hollow portion 121 of the rotation plate 120.

In addition, rotation gears 130 are provided at both sides with respect to the central gear 115 and axially coupled to rotation gear shafts 140, such that the rotation gears 130 orbit together with the rotation plate 120 in a state, in which the rotation gears 130 are inserted into through holes 122 provided in the rotation plate 120, and simultaneously rotate in a state, in which the rotation gears 130 are engaged with the central gear 115.

Herein, the rotation gears 130 include upper rotation gear parts 131 and lower rotation gear parts 132 which are respectively provided at the upper portions and the lower portions with respect to bearings 133 so as to operate in association with each other.

Figure 10:
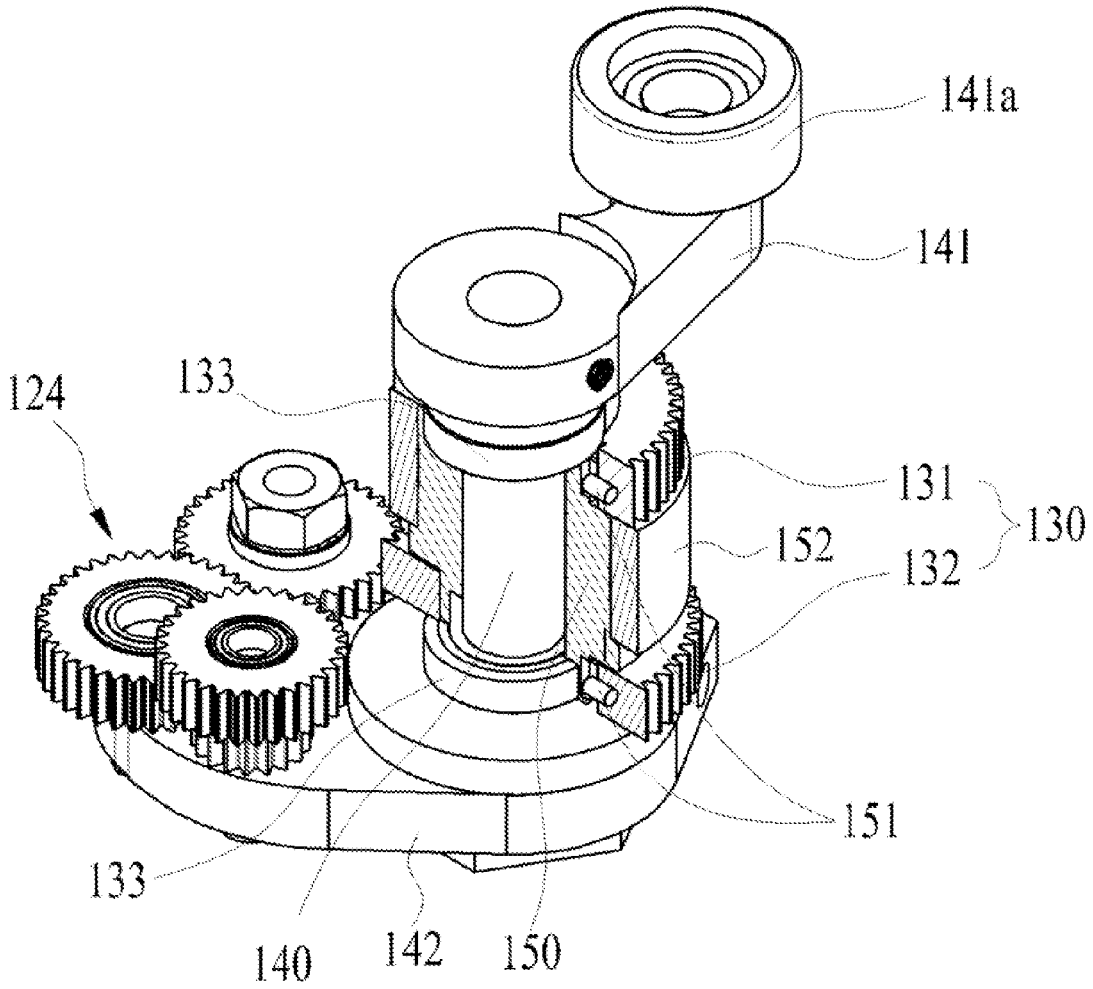
FIG. 10 is a perspective view showing the link operation part according to the present invention.

At this time, referring to FIG. 10, the upper rotation gear parts 131 and the lower rotation gear parts 132 are integrally fixed to gear support members 150 by fixing pins 151 so as to rotate simultaneously with each other, wherein the gear support members 150 are provided to encompass the outside portions of the rotation gear shafts 140.

Figure 11:
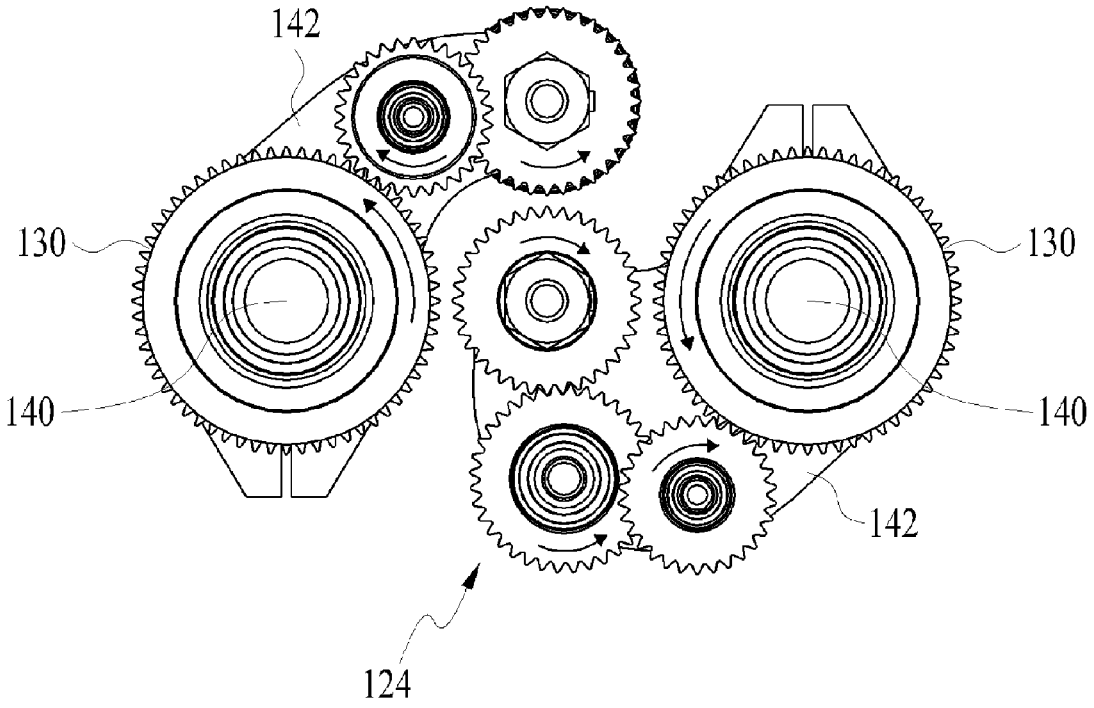
FIG. 11 is a plane view of FIG. 9, showing the rotation direction of the gears.

Therefore, referring to FIG. 11, the upper rotation gear parts 131 rotating by the central gear 115 rotate the lower rotation gear parts 132 and a plurality of gears 124, which are continuously engaged with the lower rotation gear parts 132, thereby finally applying rotation force to a mold part 160 which forms sealing lips.

Of course, the upper and lower rotation gear parts 131, 132 fixed to the rotation gear shafts 140 have separate operation relations from the rotation gears 130, resulting from the coupling between the rotation gear shafts 140 and the gear support members 150 through bearings 152.

In addition, a plurality of upper and lower connection links 141, 142 are axially fixed as link operation parts for rotating in the same direction to the upper and lower ends of the rotation gear shafts 140.

In particular, rotation levers 141*a* are coupled to the ends of the upper connection links 141 and move at a predetermined angle in the outward direction together with the upper connection links 141 by the pressing operation of the stepped cam 114*a* of the cam part 114.

Herein, even though the upper connection links 141 and the rotation levers 141*a* provided at both left and right sides with respect to the central shaft 111 can operate by the stepped cam 114*a* in a state, in which the upper connection links 141 and the rotation levers 141*a* are maintained at the same height, it is preferable that the upper connection links 141 and the rotation levers 141*a* are maintained at different height from each other for the smooth operations of the cam part 114. That is, the stepped cam 114*a* of the cam part 114 is formed in a two-stage cam structure, as shown in FIG. 4.

As described above, the rotation force of the upper connection links 141 and the rotation levers 141*a* which move in the outward direction by the camp part 114 is intactly transmitted to the lower connection links 142 which are axially fixed to the lower ends of the rotation gear shafts 140 such that the lower connection links 142 move in the same direction as the upper connection links 141.

Figure 5:
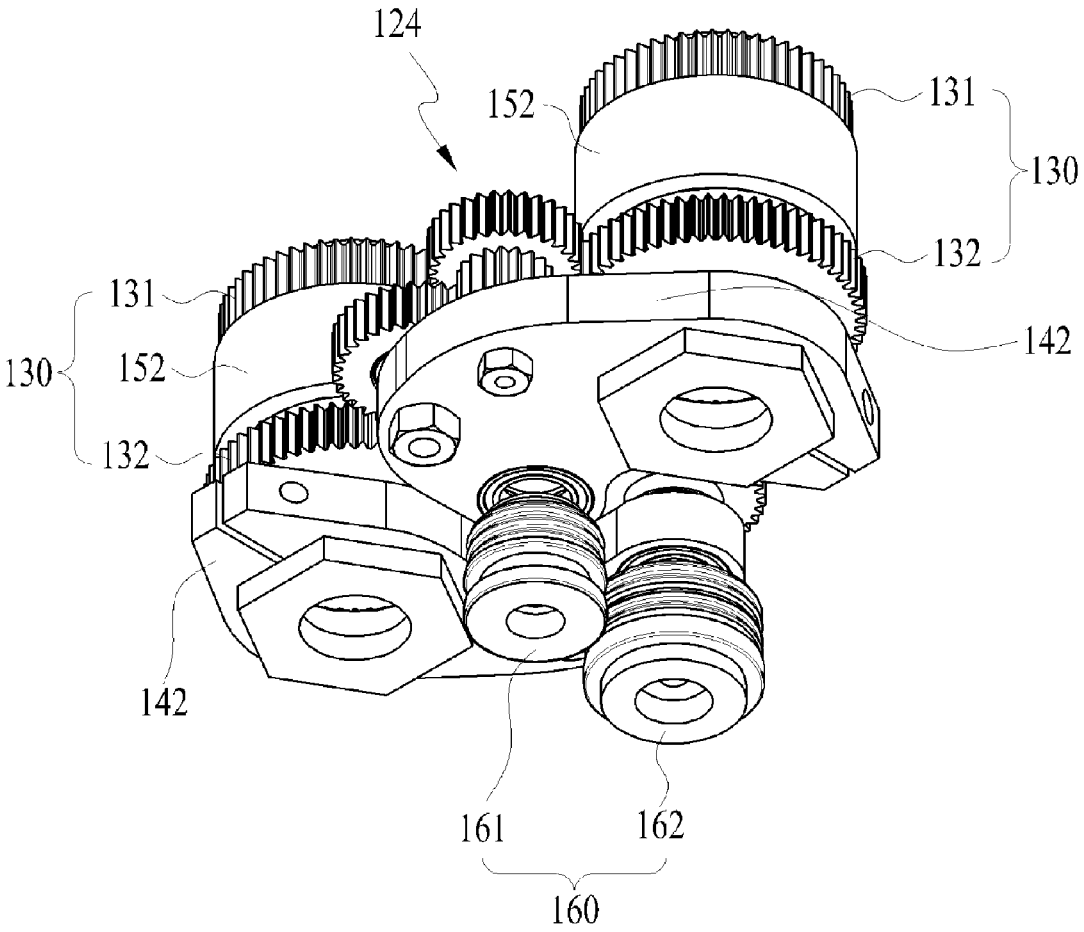
FIG. 5 is a bottom perspective view showing the lip processing structure according to the present invention.

As shown in FIG. 5, the mold part 160 includes one pair of a first mold 161 and a second mold 162 which neighbor each other and are respectively connected to the lower connection links 142 so as to continuously rotate by the plurality of gears 124 or operate in association with the lower connection links 142, wherein the first mold 161 is axially fixed to the lower end portion of the central shaft 111 on the same line therewith and positioned at one of the lower connection links 142 so as to be inserted into the bottle neck of a metallic can C, and the second mold 162 is positioned at the other lower connection link 142 neighboring the lower connection link 142 at which the first mold 161 is positioned and applies compression force to the bottle neck of the metallic can C together with the first mold 161 at the outside of the bottle neck of the metallic can C.

The upper connection links 141 and the lower connection links 142 are provided to be approximately perpendicular to each other with respect to the rotation gear shafts 140 such that, if the stepped cam 114*a* of the cam part 114 moves the rotation levers 141*a*, which are connected to the upper connection links 141, in the outward direction, the first mold 161 and the second mold 162 move in different directions from each other in such a way that the first mold 161 moves in a direction deviating from the central shaft 111 and the second mold 162 moves in the central shaft 111 direction.

Figure 8:
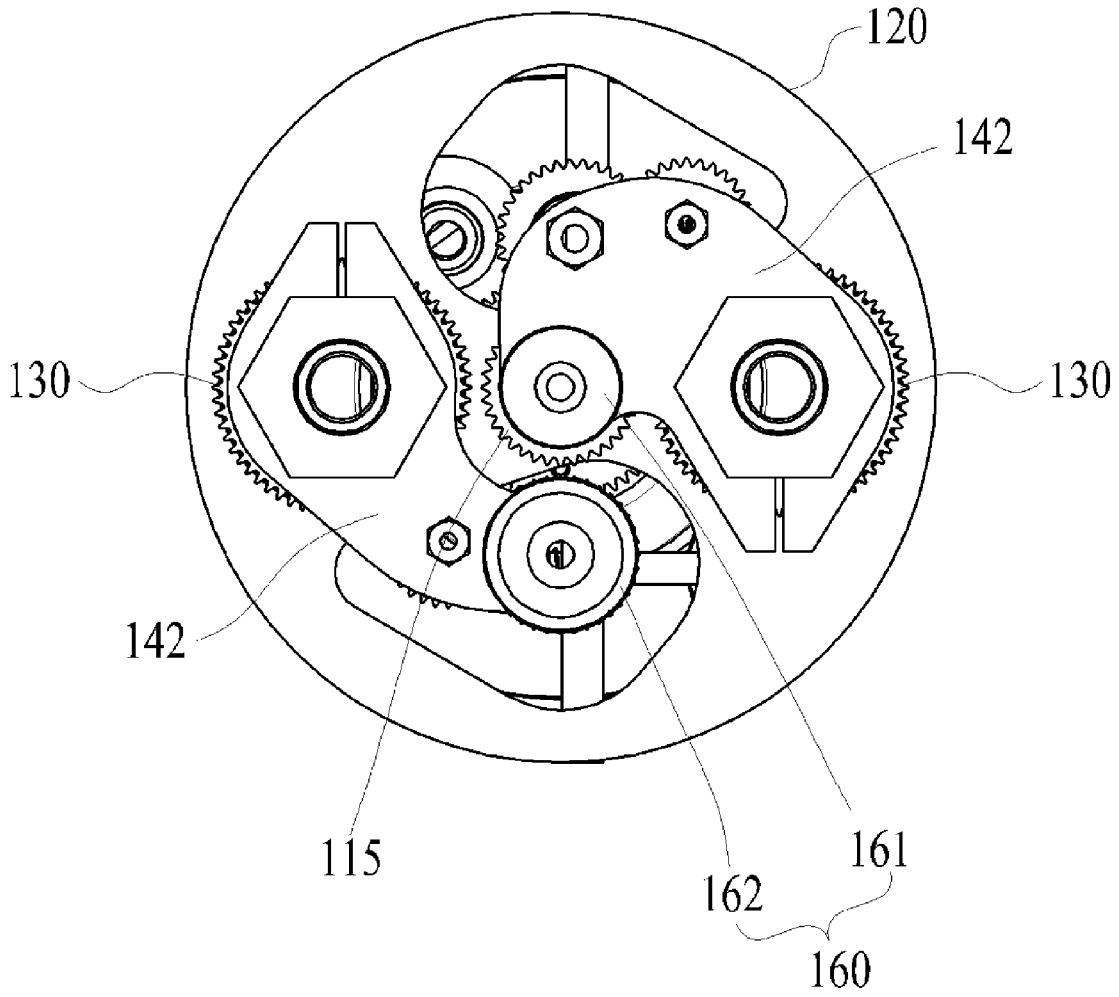
FIG. 8 is a bottom view showing the lip processing structure according to the present invention.

Therefore, the first mold 161 and the second mold 162 move each other while the bottle neck of the metallic can C is positioned therebetween and respectively compress the inside portion and the outside portion of the metallic can C so as to form a sealing lip, as shown in FIG. 8.

Figure 9:
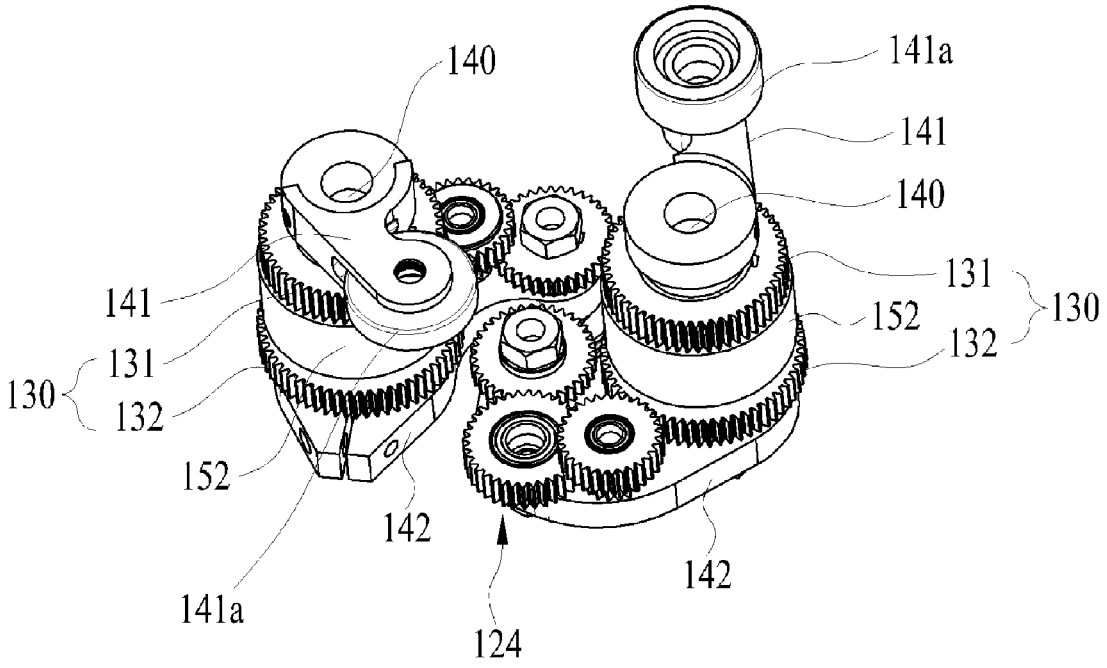
FIG. 9 is a perspective view showing the constituent elements of link operation parts and gear parts according to the present invention.

Herein, referring to FIG. 9, the plurality of gears 124 continuously engaged with the lower rotation gear parts 132 are provided at the upper portions of the lower connection links 142 and the number of the gears 124 can be varied according to the size of the lower connection links 142 and the gears 124.

Figure 6:
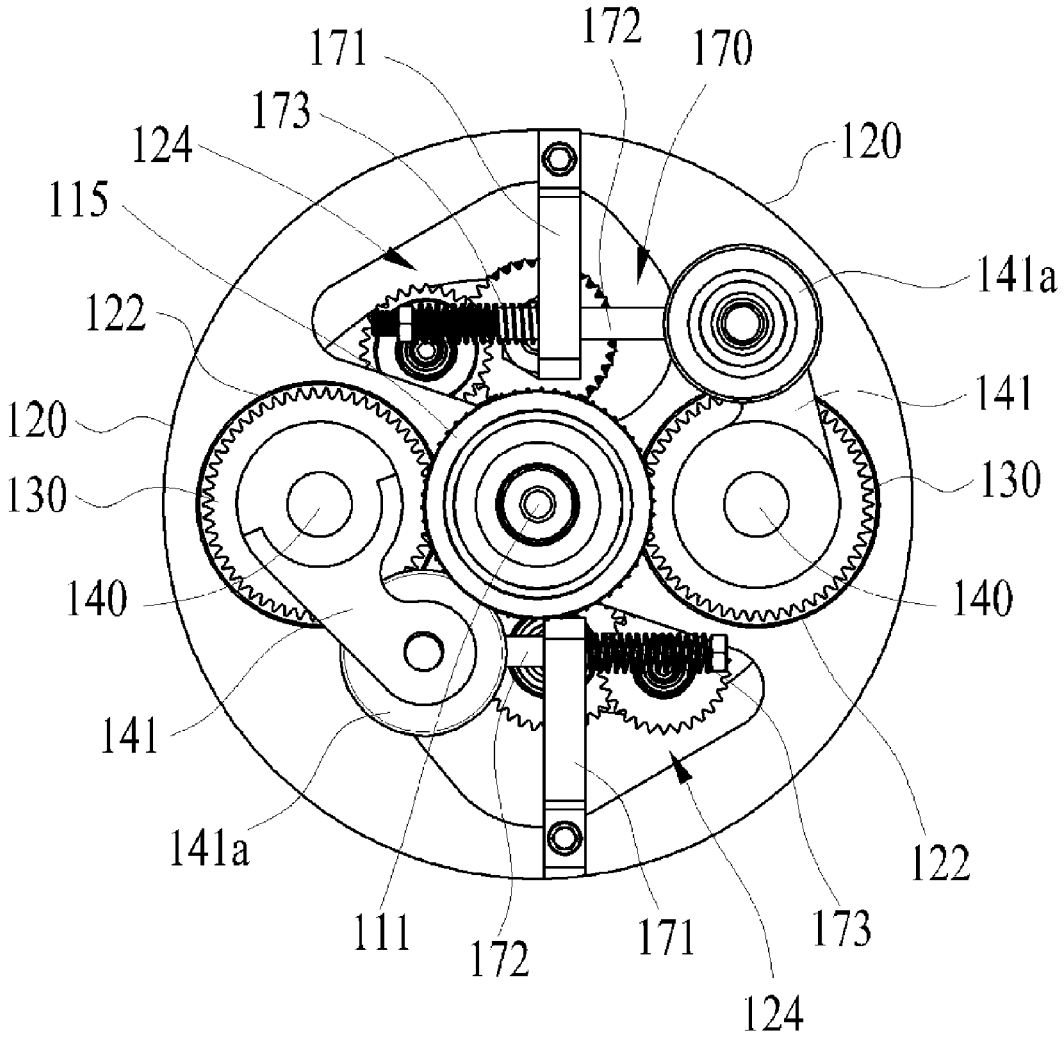
FIG. 6 is a plane view showing the lip processing structure according to the present invention.
Figure 7:
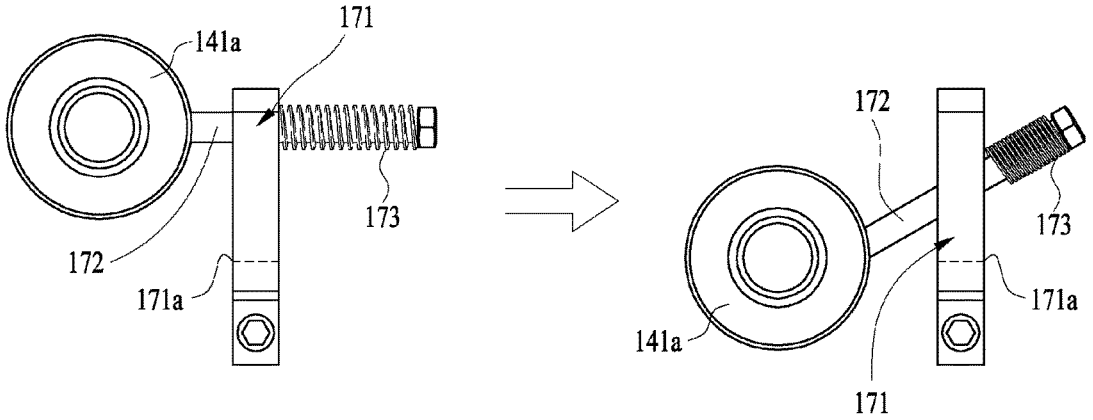
FIG. 7 is an operation view showing restoring members according to the present invention restoring members.

Meanwhile, as shown in FIG. 6 and FIG. 7, the rotation plate 120 is provided with restoring members 170 for restoring the rotation levers 141*a* to original positions thereof after the rotation levers 141*a* move in the outward direction by the cam part 114.

The restoring members 170, formed in the shape of a rod so as to be slantingly guided with respect to the rotation plate 120 along to the slit holes 171*a* of the fixing parts 171, include fixing parts 171 having slit holes 171*a* provided in the side surfaces in the central shaft 111 direction, and rod parts 172 having a predetermined length, and of which one side end portions are fixed to the lower ends of the rotation levers 141*a* and the other side end portions are inserted by compression springs 173 which reach the side surfaces of the slit holes 171*a* of the fixing parts 171.

Therefore, when the rotation levers 141*a* move in the outward direction by the press operation of the cam part 114, the rod parts 172 of the restoring members 170 are guided backwards along the slit holes 171*a* of the fixing parts 171 and simultaneously the compression springs 173 are compressed. Thus, if the rotation levers 141*a* are released from the press operation of the cam part 114, the rotation levers 141*a* are restored to be positioned in the original states thereof by the restoring force of the compression springs 173.

Meanwhile, according to the present invention, the bearing applied to the lip processing structure 100 may be realized by a ball bearing, a roller bearing or a needle bearing or may be a surface-contact bearing for the increase of frictional force.

In addition, as shown in FIG. 2, the curling part processing structure 200 is provided at the rear portion of the guide 30, at which the lip processing structure 100 is positioned, so as to process a curling part to the metallic can C for which the sealing lip has been processed.

Figure 12:
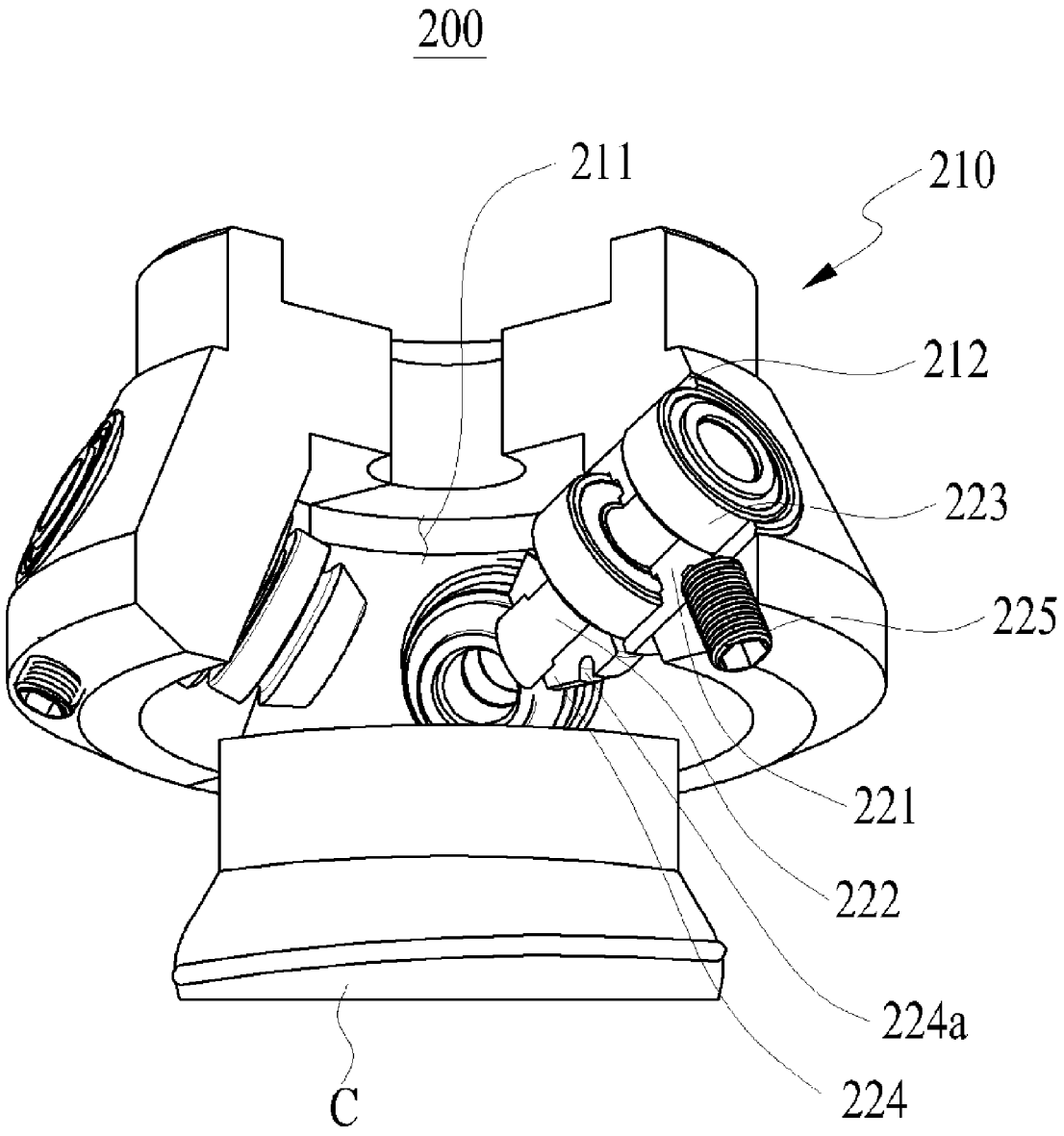
FIG. 12 is a perspective view showing a curling part processing structure according to the present invention.

As shown in FIG. 12, the curling part processing structure 200 includes a main body part 210 axially connected to the press 20 and moving in the vertical direction simultaneously with rotating at the upper portion of the bottle neck of the metallic can C for which the sealing lip has been processed.

The main body part 210 is provided with a hollow inner space 211 so as to be inserted by the bottle neck of the metallic can C, and a plurality of curling processing parts 220 are provided to the peripheral surface of the main body part 210. The curling processing parts 220 are provided towards the axial center of the main body part 210, wherein curling processing pieces 224, which are mentioned hereinbelow, are exposed towards the inner space 211 so as to process a curling part to the bottle neck of the metallic can C.

The curling processing parts 220 includes support members 221 inserted into through holes 212 formed in the peripheral surface of the main body part 210, curling shafts 222 extending in the central directions of the support members 221, bearings 223 provided between the support members 221 and the curling shafts 222 and enabling the curling shafts 222 to rotate, the curling processing pieces 224 connected to the end portions of the curling shafts 222 and having processing grooves 224*a* for processing a curling part to the bottle neck, and control screws 225 for appropriately adjusting the positions of the curling shafts 222 before curling processing.

That is, if the main body 210 rotates in a state, in which the curling processing pieces 224 provided to the processing grooves 224*a* of the curling processing parts 220 of the curling part processing structure 200 are inserted into the upper end portion of the metallic can C, the bottle neck of the metallic can C is curled while a pre-curling process and a curling process are performed.

Figure 13:
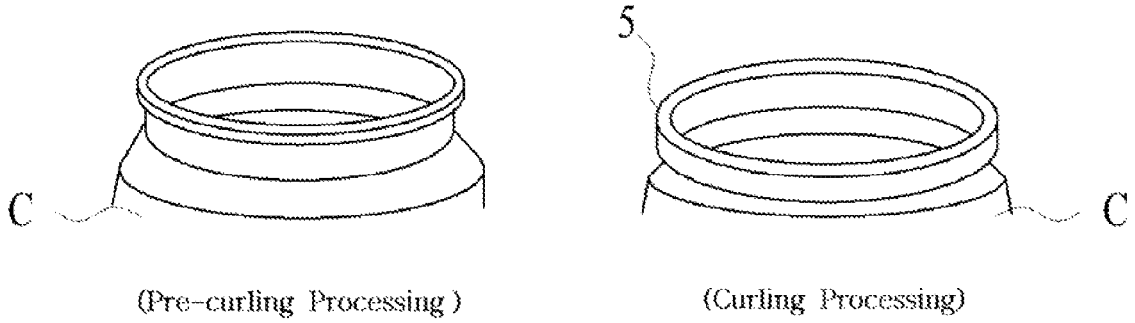
FIG. 13 is a perspective view showing a can manufactured by the pre-curling process and curling process of the curling part processing structure according to the present invention.

FIG. 13 is a view showing a can manufactured by the pre-curling process and the curling process according to the present invention, wherein the end portion of the bottle neck of the metallic can C is lowered in the outward direction and folded in the inward direction.

Hereinafter, a method for forming a sealing lip and a curling part of a metallic can, according to the present invention, will be described in more detail.

First, for a metallic can C, of which drawing and necking processing has been finished, the bottle neck portion of the metallic can C is continuously formed to process the sealing lip in the shape of a screw and the curling part during the metallic can C is linearly moved by a plurality of convey means.

In order to form the sealing lip, the shaft driving part 110 of the lip processing structure 100 is driven such that the shaft driving part 110 moves in the vertical direction by the press 20 and thus the central shaft 111 rotates by the driving force of the driving motor.

At this time, the central shaft support 113 and the cam part 114 which share the central shaft 111 via the bearing 112 do not rotate but just move in the vertical direction.

Next, the rotation gears 130 orbit by the rotation plate 120, which is axially fixed to the central shaft 111 and rotates, and simultaneously rotate by the central gear 115, which is fixed to the central shaft support 113, thereby transmitting rotation force to the plurality of gears 124 which are continuously engaged and operate in association.

If one of the gears 124, which is connected to the mold part 160 among the plurality of gears 124, applies the rotation force to the mold part 160, then the mold part 160 rotates at a high speed.

Simultaneously, if the cam part 114 of the shaft driving part 110 moves in the vertical direction and enables the rotation levers 141*a* of the upper connection links 141, which operate separately from the rotation gears 130, to move in the outward direction, the lower connection links 142 operating in association with the upper connection links 141 move in the inward direction and thus the first mold 161, which is connected to the lower connection links 142, and the second mold 162 move in different directions from each other in such a way that the first mold 161 moves in a direction deviating from the central shaft 111 and the second mold 162 moves in the central shaft 111 direction.

Therefore, the first mold 161 and the second mold 162 of the mold part 160 move each other while the bottle neck of the metallic can C is positioned therebetween and respectively compress the inside portion and the outside portion of the metallic can C so as to form a sealing lip.

Subsequently, after the sealing lip is provided to the metallic can C through the lip processing structure 100, the metallic can C continuously moves towards the curling part processing structure 200.

If the main body part 210 of the curling part processing structure 200 rotates while moving in the vertical direction at the upper portion of the bottle neck of the metallic can C, the processing grooves 224*a* provided to the curling processing pieces 224 of the curling processing parts 220 which are provided to the main body part 210 form a curling part at the upper end of the bottle neck of the metallic can C, thereby finishing the manufacturing of the metallic can C.

Therefore, according to the present invention, the continuous manufacturing process can be realized by simultaneously carrying out the curling part processing and the sealing lip processing by the press method and prevent the provision of any additional equipment therefor, thereby improving the efficiency of the manufacturing of metallic cans C.

Having described our invention as related to the present embodiments, it is our intention that the invention not be limited by any of the embodiments and drawings of the description. It will be understood by those skilled in the art that various modifications, combinations and changes may be made to the embodiments without departing from the scope of the present invention.

| Brief Explanation of Reference Symbols | |
|---|---|
| 100: lip processing structure | 110: shaft driving part |
| 111: central shaft | 112: bearing |
| 113: central shaft support | 114: cam part |
| 114a: stepped cam | 115: central gear |
| 120: rotation plate | 122: through hole |
| 124: gears | 130: rotation gear |
| 131: upper rotation gear parts | |
| 132: lower rotation gear parts | |
| 140: rotation gear shafts | 141: upper connection link |
| 142: lower connection link | 150: gear support members |
| 151: fixing pin | 152: bearing |
| 160: mold part | 161: first mold |
| 162: second mold | 170: restoring members |
| 171: fixing parts | 172: rod parts |
| 173: compression springs | |
| 200: curling part processing structure | |
| 210: main body part | 211: inner space |
| 212: through whole | |
| 220: curling processing part | |
| 221: support member | 222: curling shaft |
| 223: bearing | |
| 224: curling processing pieces | |
| 225: control screw | |

What is claimed is:

1. In an apparatus for manufacturing metallic cans, which includes: a lower plate forming a bottom plate; a press provided for carrying out straight movement in the vertical direction with respect to the lower plate; a forming part having a guide provided to the lower plate, a plurality of holders provided for fixing metallic cans and being conveyed along the guide and a plurality of molds provided to the press; a convey means for conveying the holders along the guide; and a driving means for driving the press, the apparatus for manufacturing metallic cans comprising:

a lip processing structure forming a sealing lip to the outside surface of the upper end of the bottle neck of a metallic can, which is conveyed in a fixed state with respect to the holder along the guide in the linear direction by the convey means, such that the sealing lip can seal the bottle neck through the coupling with a cap; and a curling part processing structure for forming a curling part at the upper end of the bottle neck, wherein the lip processing structure and the curling part processing structure are consecutively provided, wherein the lip processing structure includes:

a shaft driving part having a central shaft for moving in the vertical direction and simultaneously rotating;

a cam part provided to the shaft driving part so as to move in the vertical direction and formed to have a diameter decreasing towards the center portion thereof and to be inclined downwards;

a rotation plate axially fixed to the central shaft and transmitted with the rotation force of the central shaft;

rotation gears inserted into through hole and axially coupled to rotation gear shafts so as to orbit together with the rotation plate at both sides of the rotation plate and rotate in the engagement with the shaft driving part;

a plurality of gears positioned at the lower portion of the rotation plate and rotating in the consecutive engagement with each other by the rotation of the rotation gears;

a plurality of upper connection links and a plurality of lower connection links axially fixed to the rotation gear shafts and rotating in the same rotation direction with each other;

rotation levers provided to the end portions of the upper connection links and moving in the outward direction by the pressing operation of the cam part; and a mold part including one pair of molds neighboring each other, moving in position by the rotation of the rotation levers and the upper and lower connection links and continuously rotating by the plurality of gears.

2. The apparatus for manufacturing metallic cans according to claim 1, wherein the shaft driving part includes:

a central shaft support provided to the central shaft via a bearing, maintaining separate operation relations and having a flange part and a hollow part connected to the press so as to vertically operate; and a central gear fixed to the central shaft support so as to operate in association with the central shaft support and engaged with the rotation gears so as to transmit rotation force to the rotation gears.

3. The apparatus for manufacturing metallic cans according to claim 1, wherein the rotation gears include upper rotation gear parts and lower rotation gear parts which are respectively provided at upper and lower portions with respect to the bearing so as to operate in association with each other, and the upper rotation gear parts and the lower rotation gear parts are integrally fixed by fixing pins to gear support members for encompassing the outside portions of the rotation gear shafts.

4. The apparatus for manufacturing metallic cans according to claim 1, wherein the mold part includes:

a first mold axially fixed to the lower end portion of the central shaft on the same line therewith and positioned at one of the lower connection links so as to be inserted into the bottle neck of a metallic can; and a second mold positioned at the other lower connection link neighboring the lower connection link at which the first mold is positioned and applying compression force to the bottle neck of the metallic can together with the first mold at the outside of the bottle neck of the metallic can.

5. The apparatus for manufacturing metallic cans according to claim 1, wherein the upper connection links and the lower connection links are perpendicular to each other with respect to the rotation gear shafts.

6. The apparatus for manufacturing metallic cans according to claim 1, wherein the rotation plate is provided with restoring members for enabling the rotation levers to original states after moving in the outward direction by the cam part.

7. The apparatus for manufacturing metallic cans according to claim 6, wherein the restoring members include:

fixing parts provided with slit holes formed in side surfaces towards the central shaft direction of the shaft driving parts; and rod parts formed in the shape of a rod so as to be slantingly guided with respect to the rotation plate along to the slit holes of the fixing parts, and having rod parts formed in a predetermined length and of which one side end portions are fixed to the lower ends of the rotation levers and the other side end portions are inserted by compression springs which reach the side surfaces of the slit holes of the fixing parts.

8. The apparatus for manufacturing metallic cans according to claim 1, wherein the curling part processing structure includes:

a main body part axially connected to the press, moving in the vertical direction simultaneously with rotating at the upper portion of the bottle neck of the metallic can, for which a sealing lip has been processed, and having a hollow inner space so as to be inserted by the bottle neck of the metallic can; and a plurality of curling processing parts provided to the peripheral surface of the main body part towards an axially central direction so as to be exposed to the inner space and process a curling part to the bottle neck of the metallic can.

9. The apparatus for manufacturing metallic cans according to claim 8, wherein the curling processing part includes:

supporting members to be inserted into through holes formed in the peripheral surface of the main body part;

curling shafts extending in the central directions of the support members;

bearings provided between the support members and the curling shafts such that the curling shafts can rotate;

curling processing pieces connected to the end portions of the curling shafts and having processing grooves for processing a curling part to the bottle neck; and control screws for adjusting the position of the curling shafts before curling processing.

* * * * *